United States Patent [19]

Hilfiker et al.

[11] Patent Number: 4,643,618

[45] Date of Patent: Feb. 17, 1987

[54] SOIL REINFORCED CANTILEVER WALL

[75] Inventors: William K. Hilfiker; Arthur L. Hilfiker, both of Eureka, Calif.

[73] Assignee: Hilfiker Pipe Co., Eureka, Calif.

[21] Appl. No.: 700,552

[22] Filed: Feb. 11, 1985

[51] Int. Cl.[4] ..... E02D 5/20; E02D 29/02

[52] U.S. Cl. ..... 405/287; 405/284

[58] Field of Search ..... 405/262, 284, 285, 286, 405/287, 258

[56] References Cited

U.S. PATENT DOCUMENTS

| | | | |
|---|---|---|---|
| 1,762,343 | 6/1930 | Munster | 405/262 |
| 1,812,364 | 6/1931 | Oursler | 405/287 |
| 3,953,979 | 5/1976 | Kurose | 405/286 |
| 4,117,686 | 10/1978 | Hilfiker | 405/284 |
| 4,324,508 | 4/1982 | Hilfiker et al. | 405/284 |
| 4,329,089 | 5/1982 | Hilfiker et al. | 405/262 |
| 4,391,557 | 7/1983 | Hilfiker et al. | 405/287 |

OTHER PUBLICATIONS

"Retaining Wall Type 2-Standard Drawing", State of California Department of Transportation, Jan. 1980.

*Primary Examiner*—David H. Corbin

*Attorney, Agent, or Firm*—Limbach, Limbach & Sutton

[57] ABSTRACT

A retaining wall for an earthen formation comprising a plurality of soil reinforcing mats and a cantilevered face which is anchored in place at the foot of the formation. The mats are embedded in the formation at vertically spaced levels and secured to the face. In the preferred embodiment the face is in situ formed concrete and the mats comprise welded wire trays with end portions cast in place within the face.

8 Claims, 3 Drawing Figures

SOIL REINFORCED CANTILEVER WALL

BACKGROUND OF THE INVENTION

The present invention relates to a retaining structure for earthen formations which employs the principles of cantilever walls and soil reinforced walls, in combination. In its more specific aspects, the invention is concerned with such a structure wherein the cantilever wall is in situ formed concrete and the soil reinforcing wall is comprised of welded wire mats embedded in the earthen formation with ends of the mats secured to the concrete.

Cantilever walls are well-known in the prior art. Such walls typically include a large reinforced concrete buttress which is formed at the foot of the formation to be retained and extends upwardly across the face of the formation. The buttress is generally keyed to the formation and buried so as to resist tipping. Lateral extensions may be formed on the buttress to further resist tipping. Such walls are necessarily of limited load-bearing capacity and, thus, generally find primary use in situations where the wall is of low or moderate height.

Soil reinforced walls are also well-known in the earth retention art. Such walls typically employ wire mats, straps, or ladder-type structures which are embedded within the earthen formation and serve to build a reinforced mass of earth which performs the retaining function. Such walls have also employed concrete faces to prevent sloughing and enhance their architectural appearance. Certain of the soil reinforced walls employing concrete faces have also provided foundations at the foot of the face to aid in supporting the face. These foundations have not, however, performed a significant cantilever function.

U.S. Pat. No. 4,117,686 discloses a soil reinforced wall wherein reinforcing is achieved through means of wire mats, without a concrete face. U.S. Pat. Nos. 4,329,089 and 4,391,557 disclose soil reinforced walls wherein in situ formed concrete faces are formed on the walls and U.S. Pat. No. 4,324,508 shows a soil reinforced wall wherein precast concrete panels are provided at the face of the wall. In the case of the latter patents, however, the concrete walls are not cantilevered. U.S. Pat. No. 1,762,343 discloses a soil reinforced wall with a concrete face wherein the face is provided with a small foundation, but this foundation does not provide a significant cantilever function.

SUMMARY OF THE INVENTION

The invention provides a structure for reinforcing and securing an earthen formation through the combination of a cantilever wall and soil reinforcement. Reinforcing is achieved through means of a plurality of soil reinforcing members embedded in the formation at vertically spaced levels. The cantilever wall has an in situ formed concrete face supported on an abutment at the foot of the formation. The abutment is anchored against both lateral movement and tilting. At least certain of the soil reinforcing members are also secured to the face of the cantilever wall.

A principal object of the invention is to provide a reinforcing and securing structure for earthen formations which employs both the principles of cantilever walls and soil reinforcement.

Another object is to provide such a structure wherein said principles are combined in a manner which optimizes stability and accommodates heights which would exceed those normally possible with cantilever walls.

Still another object is provide a method of forming such a structure wherein the foundation and face of the cantilever wall are formed in situ, with portions of the soil reinforcing members integrally joined to the face.

Yet another object of the invention is to provide such a structure wherein the soil reinforcing members comprise welded wire mats and angled sections on the mats are cast-in-place within the face of the cantilever wall to both reinforce the wall and secure the wall against displacement relative to the reinforcing members.

A further object of the invention is to provide such a structure wherein steel reinforcements within the foundation abutment of the cantilever wall extend into the wall and overlap portions of the soil reinforcing members disposed within the wall.

Another object is to provide such a structure wherein the soil reinforcing members are provided with connectors to which a form panel for poured concrete may be secured.

The foregoing and other objects will become apparent when viewed in light of the following description and accompanying drawings.

DESCRIPTION OF THE PREFERRED EMBODIMENT

Figure 1:
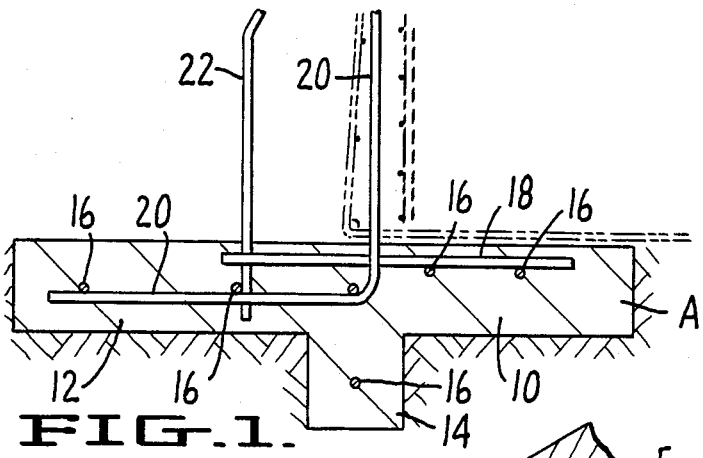
FIG. 1 illustrates the foundation abutment for the cantilever wall of the invention in advance of formation of the face of the wall thereabove.

The earthen formation shown in the drawings is designated by the letter "E" and is shown terminating in a foot "F". In the course of preparing the formation for retention through means of the method and apparatus of the present invention, the formation is first excavated away and then rebuilt, from the bottom up.

The first step in building the retention structure and rebuilding the formation is shown in FIG. 1. As there seen, a foundation abutment "A" is in place at the foot of the formation. The abutment is formed of in situ placed reinforced concrete. It comprises a forward extension 10 extending beneath the area of the formation "E", a rearward extension 12 extending forwardly of the formation, and a key 14 extending downwardly into the foot. This structure, as will become more apparent from the following discussion, serves as a foundation for the face of a cantilever wall cast thereabove and anchors the wall against tilting and shifting.

The abutment is reinforced by steel rebar cast in place therein. This rebar includes longitudinally extending members 16, first transverse members 18 which extend through the extension 10, second transverse members 20 which extend through the extension 12 and upwardly therefrom, and upwardly extending backing members 22. In the initial condition shown in FIG. 1 the upwardly extending portions of the members 20 and 22 have free distal ends positioned to be cast in place within the face of the cantilever wall to be formed on the foundation abutment "A". Thus, these members serve to rigidly interconnect the wall with the abutment.

The soil reinforcing members of the invention comprise welded wire trays "T". These trays are similar in their construction and placement to those shown in aforementioned U.S. Pat. No. 4,391,557. In a typical embodiment, the trays comprise a gridwork of welded wire rods wherein the transversely extending cross rods "c" are spaced from one another by six to twelve inches and the longitudinally extending rods "1" are spaced from one another by two to six inches and welded to the rods "c" at the intersections therewith. The wire is typically of about seven gauge.

The horizontal "body" sections of the trays are of a length chosen to provide stability to the earthen formation. As compared to the trays of U.S. Pat. No. 4,391,557, these portions may be of a lesser length, since in the present structure the cantilever wall carries some of the earth retaining load. The angled sections of the tray extending from the formation are chosen to have a height somewhat greater than the distance between successive trays. The latter distance might be sixteen inches, or more, depending upon the stability of the soil making up the earthen formation.

The angled sections of the trays include a first portion 24 extending upwardly at an angle relative to the elongate tray body; a second portion 26 extending from the first portion and toward the earthen formation; and the third portion 28 extending from the second portion in spaced relationship to the first portion. The third portion, as may be seen from FIGS. 2 and 3, serves as a support for wire backing mats 30.

Figure 2:
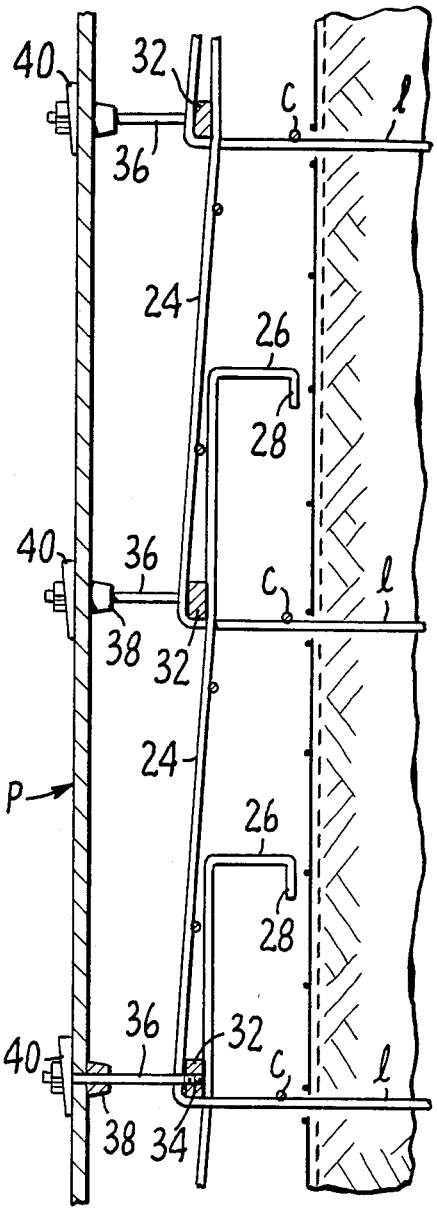
FIG. 2 is a fragmentary cross-sectional view of an earthen formation in the process of having the structure of the present invention applied thereto, illustrating soil reinforcing members in place within the formation and a form panel secured to the members in preparation for in situ placement of the face of the cantilever wall.

After the earthen formation has been excavated and the foundation abutment has been placed, as seen in FIG. 1, the wall is assembled by successively placing and backfilling each of the trays "T" to form a composite assembly as shown in FIG. 2. The first and second layers of the trays are threaded over the upwardly extending ends of the rods 20 so that the angled sections of these trays overlap the rods. As each tray is placed, a backing mat 30 is positioned against the portions 28. Wire ties (not illustrated) then may be used to secure the backing mats against displacement from the portion 28. Screens (not illustrated) may be placed against the backing mats 30 to prevent the passage of soil through the mats during backfilling.

The successive layers of trays are placed so that the angled section of each tray extends behind the angled section of the tray thereabove. Transverse bars 32 are positioned at the intersection between the horizontal body section and the angled section of each tray so as to be captured by the angled section of the tray therebeneath. These bars are formed with threaded openings 34 for the receipt of snap ties 36 (see FIG. 2). The uppermost tray "T1" shown in FIG. 3 has the angled section thereof foreshortened and bent sharply over the bar 32 engaged therewith.

Figure 3:
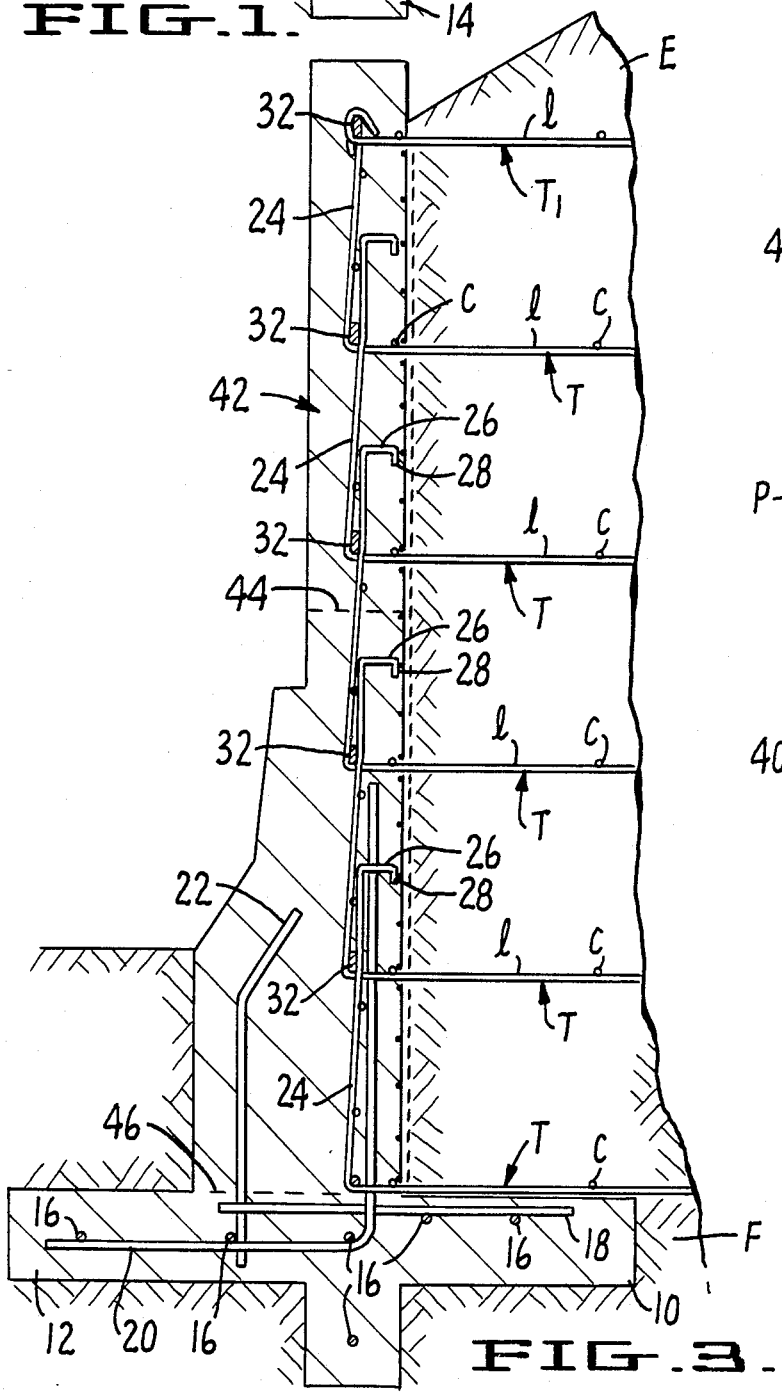
FIG. 3 is a cross-sectional elevational view illustrating the structure of the invention in place within an earthen formation.

After the trays are fully positioned and the soil layers therebetween are backfilled, the face of the cantilever wall is formed in situ. This is achieved by first securing a form panel "P" to the trays "T" through means of snap ties 36 threaded into the bars 32. The snap ties are of conventional construction and each carry a cone 38 engaged with the inside of the form panel to maintain it in spaced relationship to the backing mats 30. Wedges 40 engaged beneath heads on the ties hold the panel against the cones. As shown in FIG. 3, the lowermost portion of the cantilever wall is formed so as to be thicker than the upper portion. This provides a weighted mass of concrete which reinforces the wall and forms a rigid cantilever connection between the wall and the abutment foundation "A".

With the form panel "P" in place, the face of the cantilever wall, designated 42, is formed in situ by pouring concrete between the panel "P" and the backing mats 30. The concrete is tamped into place to assure its integrity. It may also be poured in layered segments. Phantom line 44 shown in FIG. 3 depicts the interface between two such segments. The phanton line 46 shown in FIG. 3 illustrates the interface between the foundation abutment "A" and the lower portion of the face 42.

Once the face is sufficiently cured, the snap ties 36 are broken and the form panels "P" are removed. The cones 38 leave conical openings in the outer surface of the face which may, if desired, be grouted over.

After the face 42 is cured and the form panels have been removed, earthen backfill is also placed over the extension 12 of the abutment "A". This aids in further anchoring the abutment in place. The primary anti-tilting function of the abutment however, is provided by the extension 10 which is disposed beneath the earthen backfill "E".

Conclusion

From the foregoing description, it is believed apparent that the present invention provides a structure which combines the attributes of a soil reinforced and a cantilever wall. This results in greater flexibility of design than would be possible were only one or the other type of wall provided. For example, it may facilitate the use of reinforcing trays which are shorter than those which would be required if the principles of soil reinforcement only were used. It also accommodates walls of greater height than would possible normally be where using only a cantilever wall construction.

While the invention has only been described with reference to soil reinforcement members in the form of wire trays, it is anticipated that the invention may find use with other forms of soil reinforcement, such as strap or ladder-type constructions. Accordingly, it should be understood that the invention is not intended to be limited to the specifics of the illustrated embodiment, but rather is defined by the accompanying claims.

We claim:

1. A structure for reinforcing and securing an earthen formation, said structure comprising: a plurality of welded wire trays having elongate body sections embedded in the formation at vertically spaced levels to provide a largely self-supporting reinforced earthen mass, said trays having angled sections at the face of the formation; an in situ formed concrete face, at least certain of said angled sections being cast in place within said concrete face; a cantilever abutment fixed to the face at the foot of the formation; anchor means securing the abutment against tilting and lateral movement; and wherein said certain angled sections each comprise: a first portion extending at an angle relative to the elongate body section so as to be disposed within the concrete face, a second portion extending from the first portion and toward the earthen formation, and a third portion extending from the second portion in spaced relationship to the first portion, said third portion serving as a support to space a backing mat from the first portion.

2. A structure for reinforcing and securing an earthen formation, said structure comprising: a plurality of welded wire trays having elongate body sections embedded in the formation at vertically spaced levels to provide a largely self-supporting reinforced earthen mass, said trays having angled sections at the face of the formation so disposed that the angled sections of trays disposed at successive vertically spaced levels overlap; an in situ formed concrete face, at least certain of said angled sections being cast in place within said concrete face; a cantilever abutment fixed to the concrete face at the foot of the formation; anchor means securing the abutment against tilting and lateral movement; and bars captured between the overlapping portions of the angled sections, said bars having screw threaded means for threaded receipt of snap ties adapted to support forming panels to the side of the angled sections opposite the earthen formation.

3. A structure for reinforcing and securing an earthen formation, said structure comprising: a plurality of soil reinforcing members embedded in the formation at vertically spaced levels to provide a largely self-supporting reinforced earthen mass; an in situ formed concrete face; a concrete cantilever abutment fixed to the face at the foot of the formation, said abutment having integrally formed therewith a base and a key section, said base having a first planar portion extending laterally from the face beneath the earthen formation and a second planar portion extending laterally from the face to the side thereof opposite the earthen formation, said key section extending downwardly from the base and longitudinally of the base in a direction generally parallel to the face; and securing means connecting at least certain of the reinforcing members to the face.

4. A structure according to claim 3 further comprising reinforcing steel embedded within the abutment, said steel including rebar extending across the first and second planar portions, at least certain of said rebars being bent to extend from the base and into the face.

5. A structure according to claim 4 wherein: the reinforcing members comprise welded wire trays having elongate body sections with angled sections at one end thereof; the body sections are embedded in the formation; the angled sections are cast in place within the face to provide the securing means; and the angled sections of at least certain of the mats are cast in place in the abutment in superimposed relationship to the bent rebars extending from the base.

6. A method of reinforcing and securing an earthen formation, said method comprising: forming an intergral concrete abutment at the foot of the formation to provide a foundation having portions extending forwardly and rearwardly of the formation and a key securing the abutment against lateral movement relative to the formation; disposing reinforcing steel within the abutment to reinforce said portions and provide reinforcing bars integral with the abutment and extending upwardly therefrom in front of the formation; embedding soil reinforcing members in the formation at vertically spaced locations to provide a largely selfsupporting earthen mass; forming a concrete face in front of the formation and over the reinforcing bars extending upwardly from the abutment to provide a wall cantilevered to the abutment; and securing the wall to at least certain of the soil reinforcing members disposed at vertically spaced locations.

7. A method according to claim 6 wherein the soil reinforcing members comprise welded wire mats and said members are secured to the wall by casting portions of the mats within the wall.

8. A method according to claim 7 wherein: the mats include angled sections; the angled sections of successive vertically spaced mats are so disposed as to overlap; and the angled sections of at least certain of the mats are so disposed as to overlap the reinforcing bars extending upwardly from the abutment.

* * * * *